US009261337B1

(12) United States Patent
Monda et al.

(10) Patent No.: US 9,261,337 B1
(45) Date of Patent: Feb. 16, 2016

(54) PRECISION DISABLEMENT AIMING SYSTEM

(71) Applicant: Sandia Corporation, Albuquerque, NM (US)

(72) Inventors: Mark J. Monda, Albuquerque, NM (US); Clinton G. Hobart, Albuquerque, NM (US); Thomas Scott Gladwell, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 221 days.

(21) Appl. No.: 14/071,833

(22) Filed: Nov. 5, 2013

(51) Int. Cl.
*G06F 19/00* (2011.01)
*F42B 12/02* (2006.01)

(52) U.S. Cl.
CPC ..... *F42B 12/02* (2013.01)

(58) Field of Classification Search
USPC ..... 235/404, 401; 42/114, 115
See application file for complete search history.

(56) References Cited

U.S. PATENT DOCUMENTS

| | | | | |
|---|---|---|---|---|
| 7,523,582 | B1 * | 4/2009 | Ahrens et al. | 42/115 |
| 7,533,597 | B1 | 5/2009 | Strohman | |
| 2002/0096079 | A1 | 7/2002 | Alford | |
| 2003/0041722 | A1 | 3/2003 | Alexander et al. | |
| 2005/0066799 | A1 | 3/2005 | Fish | |
| 2005/0081706 | A1 | 4/2005 | Alford | |
| 2012/0180366 | A1 * | 7/2012 | Jaroh et al. | 42/114 |
| 2012/0180644 | A1 | 7/2012 | Langner | |
| 2012/0221144 | A1 * | 8/2012 | McElroy et al. | 700/259 |
| 2014/0245880 | A1 * | 9/2014 | Rabec Le Gloahec | 89/1.13 |

* cited by examiner

*Primary Examiner* — Ahshik Kim
(74) *Attorney, Agent, or Firm* — Daniel J. Jenkins

(57) ABSTRACT

A disrupter to a target may be precisely aimed by positioning a radiation source to direct radiation towards the target, and a detector is positioned to detect radiation that passes through the target. An aiming device is positioned between the radiation source and the target, wherein a mechanical feature of the aiming device is superimposed on the target in a captured radiographic image. The location of the aiming device in the radiographic image is used to aim a disrupter towards the target.

19 Claims, 9 Drawing Sheets

PRECISION DISABLEMENT AIMING SYSTEM

STATEMENT OF GOVERNMENTAL INTEREST

This invention was developed under Contract DE-AC04-94AL85000 between Sandia Corporation and the U.S. Department of Energy. The U.S. Government has certain rights in this invention.

BACKGROUND

Disrupters are mechanisms that are configured to emit a projectile towards the target for purposes of disrupting or disabling a target, where disruption of the target refers to inhibiting the target from performing a task, while disablement of the target refers to preventing the target from performing the task (e.g., through destroying the target). For example, a disrupter has conventionally been employed for purposes of disrupting and disabling an explosive device, such as an improvised explosive device (IED). In a more specific example, a disrupter has conventionally been used to disrupt or disable a battery, such as a 9V battery, in an explosive device. The disrupter is aimed at the battery, and a projectile emitted from the disrupter impacts the battery, thereby, for example, disabling the battery (and thus the explosive device).

Conventional means, however, for aiming a disrupter towards a target are relatively imprecise. While aiming precision is not necessary for all applications of disrupting or disabling a target, in many scenarios, higher precision in aiming the disrupter may be desirable, such as when componentry of electronics coupled to an explosive is desirably analyzed to ascertain information pertaining to an explosive device, such as the manufacturer of the explosive device, place of origin of the explosive device, etc.

SUMMARY

The following is a brief summary of subject matter that is described in greater detail herein. This summary is not intended to be limiting as to the scope of the claims.

Described herein are various technologies pertaining to relatively precisely aiming a disrupter with respect to a target are described herein, wherein the disrupter can be aimed with precision on the order of millimeters. An exemplary system includes a radiation source (e.g., an x-ray source) that is configured to emit radiation towards a proximal side of a target. In an example, the target may be or include a component of an explosive device, a surface-mounted circuit component, or the like. A detector is positioned on an opposite side of the target from the radiation source, such that the detector detects radiation emanating from a distal side of the target. Accordingly, through utilization of the radiation source and the detector, a radiographic image of the target can be generated.

The system additionally includes an aiming device that is positioned between the radiation source and the proximal side of the target when the radiographic image is generated. Thus, the radiographic image can include the target and the aiming device superpositioned thereon. A position in the radiographic image of the aiming device is referred to as an aim point. An analyst can review the radiographic image and ascertain if the aim point is at a desired location relative to the target. If the position of the aim point is not at the desired location relative to the target, the analyst can cause the position of the aiming device to be adjusted. A new radiographic image is then generated, and a location of the aim point in the new radiographic image is reviewed by the analyst. This process can repeat until the aim point is at the desired location in a radiographic image.

When the analyst indicates that the aim point is at the desired location, the analyst can cause a disrupter to be aimed at the target at a location thereon that corresponds to the location of the aim point on the target in the radiographic image. With more specificity, the disrupter is configured to emit a disrupting entity (e.g., a projectile, a laser beam, etc.) along a projecting axis, and the disrupter can be positioned such that the projecting axis intersects the location on the target that corresponds to the location of the aim point in the radiographic image. Positioning of the disrupter in this manner can be accomplished by way of a variety of techniques. For instance, the aiming device can be an attachment to a housing of the radiation source, and can be detached when the aim point is at the desired location. The disrupter can also be an attachment to the housing, and can replace the aiming device when the aim point is at the desired location. In another example, the aiming device and the disrupter can be mechanically linked (e.g., coupled to a common shaft), and mechanical stops and/or detents can be used to position the disrupter such that the projectile emitted thereby will impact the target at the desired location.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
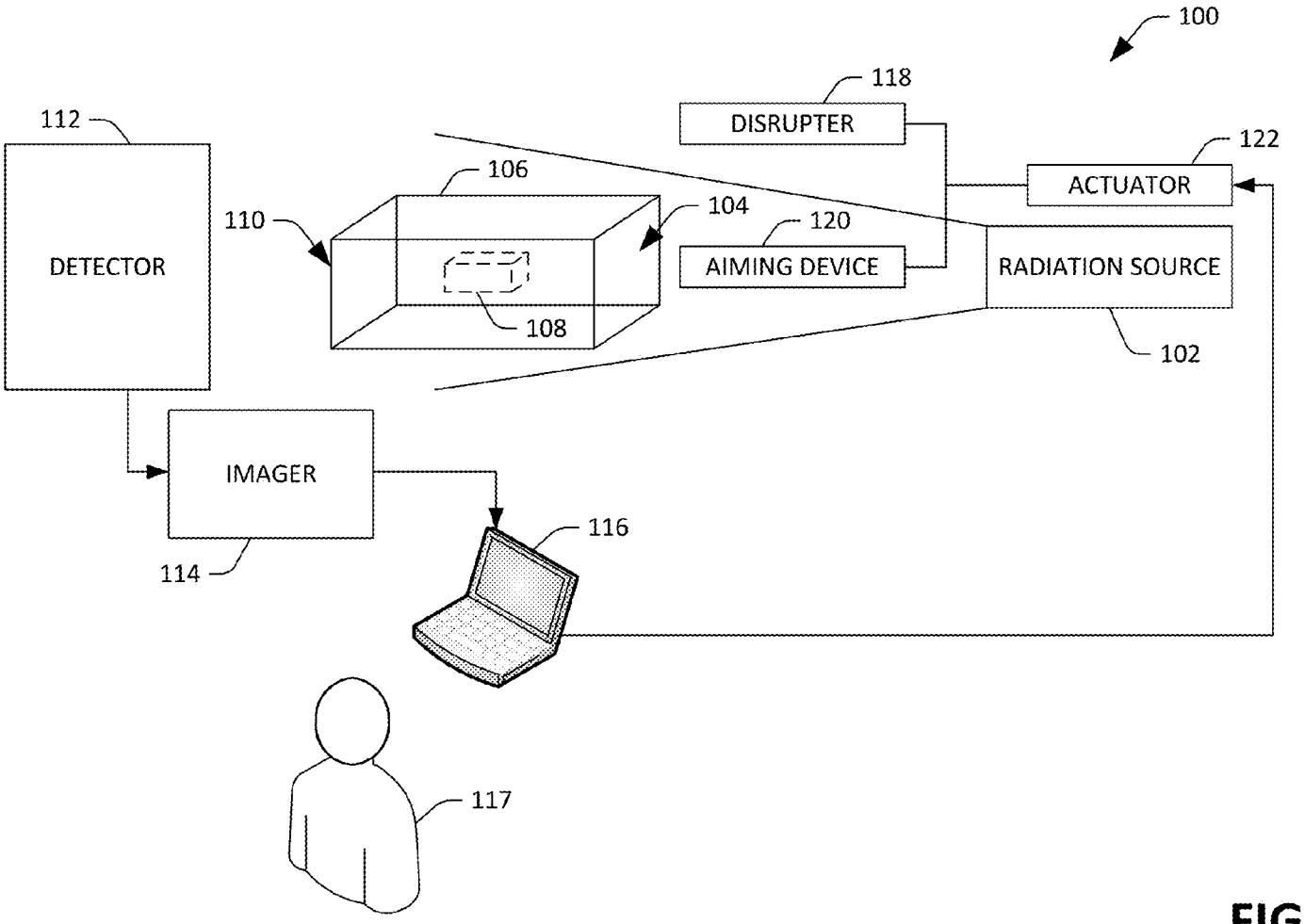
FIG. 1 is a functional block diagram of an exemplary system that facilitates relatively precisely aiming a disrupter towards a target.

Various technologies pertaining to aiming a disrupter towards a target are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by a single system component may be performed by multiple components. Similarly, for instance, a single component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. It is also to be understood that a component or system may be localized on a single device or distributed across several devices. Additionally, as used herein, the term "exemplary" is intended to mean serving as an illustration or example of something, and is not intended to indicate a preference.

Described herein are various technologies pertaining to relatively precisely aiming a disrupter towards a target. The technologies described herein are particularly well-suited for applications where a relatively small projectile (e.g., such as a relatively small explosive shape charge) desirably disrupts or disables a relatively small target, such as a surface-mounted component on a printed circuit board (PCB). The technologies described herein allow for aiming precision to be on the order of millimeters (in comparison to precision on the order of inches associated with conventional disrupter aiming techniques).

With reference now to FIG. 1, an exemplary system 100 that facilitates relatively precisely aiming a disrupter towards a target is illustrated. The system 100 includes a radiation source 102 that can emit a suitable form of radiation. In an exemplary embodiment, the radiation source 102 may be a portable x-ray source, a neutron generator, a permanently-affixed x-ray source, an ultrasound source, etc. Further, the radiation source 102 can be configured to output radiation conically. As shown in FIG. 1, the radiation source 102 is positioned to direct radiation towards a proximal side 104 of a target object 106. In an exemplary embodiment, the target object 106 can be an explosive device, such as an improvised explosive device (IED), a trigger circuit for an explosive device, etc. The target object 106 may include a target 108 therein, wherein the target 108 can be an element of the target object 106. Accordingly, for example, the target 108 may be a surface-mounted component on a PCB, such as a resistor, capacitor, inductor, etc. In other examples, the target 106 may be an application-specific integrated circuit (ASIC), microprocessor, wiring between components, a battery, etc.

The system 100 further comprises a detector 112 that is configured to detect radiation of the form emitted by the radiation source 102. As shown, the detector 110 can be positioned to detect radiation emanating from a distal side 110 of the target object 106. That is, the target object 106 is placed between the radiation source 102 and the detector 112. In an exemplary embodiment, the detector 112 can comprise film that is reactive to radiation of the form emitted by the radiation source 102. In another example, the detector 112 can be a portion of a computerized detector.

An imager 114 may be included in the system 100, wherein the imager 114 can be configured to generate a radiographic image for display on a display screen associated with a computing device 116. For example, the imager 114 may be a scanner that is coupled to the computing device 116, wherein the detector 112 comprises film that is placed on the scanner 114 to generate the radiographic image. In another example, the imager 114 can be a computer-executable component that is configured to receive values from the detector 112 and generate a radiographic image based upon such values. Further, in an exemplary embodiment, the imager 114 can relatively rapidly generate radiographic images based upon values generated by the detector 112. For instance, the imager 114 can generate images at a rate between one frame per second and one hundred frames per second. An analyst 117 can review at least one radiographic image, wherein the at least one radiographic image comprises an image of the target 108.

The system 100 can further include a disrupter 118 that is configured to emit a projectile that can disrupt or disable the target 108. In an exemplary embodiment, such projectile may be a shape charge. For example, size of such shape charge can be relatively small, such as between 1 mm and 50 mm in diameter. In an exemplary embodiment, the shape charge comprises an explosive, such as C-4, and can be lined with a copper liner. In another example, the disrupter 118 can be a laser that is configured to direct a laser beam at the target 108, thereby disrupting or disabling the target 108. Because the target 108 is relatively small and the projectile emitted by the disrupter 118 is relatively small, it is desirable that the disrupter 118 be aimed at the target 108 in a relatively precise manner.

To that end, the system 100 additionally comprises an aiming device 120, which may be mechanically attached to the radiation source 102 (as an attachment) and/or to the disrupter 118. The aiming device 120 can include mechanical alignment features that may assist the analyst 117 in aiming the disrupter 118 at the target 108. For example, the aiming device 120 may be shaped as a cylindrical barrel, having a size and shape that corresponds to size and shape of a barrel of the disrupter 118. Thus, positioning the aiming device 120 relative to the target 108 can be similar, from the perspective of the analyst 117, to positioning the disrupter 118 relative to the target 108. In such an exemplary approach, the analyst 117 can use the aiming device 120 in connection with determining a proper distance between an end of the aiming device 120 and the target object 106.

Moreover, the aiming device 120 can comprise mechanical features that can create an aim point on a radiographic image that is generated based upon output of the detector 112. In other words, when the aiming device 120 is positioned between the radiation source 102 and the target object 106, a radiographic image of the target object 106 (and thus, the target 108) can have an image of the mechanical features of the aiming device 120 superimposed thereon. The location of such mechanical features in a radiographic image is referred to herein as an aim point. In the exemplary embodiment where the aiming device 120 is formed as a hollow cylinder, a radiographic image generated when the aiming device 120 is positioned between the radiation source 102 and the target object 106 will have thereon a circular outline corresponding to the barrel of the aiming device 120. The location of such circular outline on the radiographic image is the aim point.

When the analyst 117 deems that the aim point on a radiographic image is at a desired location relative to the target 108, the disrupter 118 can be positioned to emit a disrupting element (e.g., projectile) at a location on the target 108 that corresponds to the location of the aim point in the radiographic image. With more particularity, the disrupter 118 can have a projection axis associated therewith, wherein a projectile emitted by the disrupter 118 travels along the projection axis. When the aim point is at the desired location relative to the target 108 in the radiographic image, the disrupter 118 can be positioned such that the projection axis intersects the target 108 at a location that corresponds to the location of the aim point on the radiographic image.

The positioning of the disrupter 118 in this manner can be accomplished by a variety of techniques. For example, as indicated above, the aiming device 120 may be an attachment that can attach to a housing of the radiation source 102 (or some other relatively stable structure). Once the aim point is at a desired location in the radiographic image, the aiming device 120 can be detached from the radiation source 102. The disrupter 118 can be shaped similarly to the aiming device 120, and can likewise be an attachment. The disrupter 118 can be attached to the housing of the radiation source 102 (or other stable structure) at the location where the aiming device 120 was attached when the aiming device 120 was positioned at a desired location. Thus, when attached to the radiation source 102, the projection axis of the disrupter 118 can be directed at a most recent aim point associated with the aiming device 120. In another example, the aiming device 120 and the disrupter 118 may be mechanically linked. For instance, the disrupter 118 and the aiming device 120 can be coupled to a common shaft, wherein the shaft can be rotated to cause the disrupter 118 to take the place of the aiming device 120 in space. This can be accomplished, for example, through utilization of mechanical stops, detents, etc.

The system 100 may further include an actuator 122 that is configured to drive at least one of the disrupter 118 or the aiming device 120. In other words, the actuator 122 can cause at least one of the disrupter 118 or the aiming device 120 to alter position in space, tilt, etc. Pursuant to an example, the actuator 122 can drive the disrupter 118 and/or the aiming device 120 responsive to receipt of a control signal from the computing device 116. As will be described in greater detail herein, the analyst 117 can review a radiographic image displayed on a display screen associated with the computing device 116, wherein the radiographic image has the aim point superimposed on the target 108. The imager 114 is configured to generate updated radiographic images relatively rapidly, as the analyst 117 controls the location of the aiming device 120 through interaction with, for example, the radiographic image shown on the display screen of the computing device 116. That is, the analyst 117 can select a location on the radiographic image where the aim point is desirably located (e.g., a new aim point), which causes the aiming device 120 to be relocated by the actuator 122. On a subsequently generated radiographic image, the new aim point is positioned at the desired location on the radiographic image. Once the analyst 117 confirms that the new aim point corresponds to the location on the target 108 as desired, the computing device 116 can output a signal to control the actuator 122, thereby causing the disrupter 118 to be aimed at the location on the target that corresponds to the location of the aim point in the radiographic image. Thereafter, the analyst 117 can cause the disrupter 118 to emit the projectile, thereby disrupting or disabling the target 108.

Figure 2:
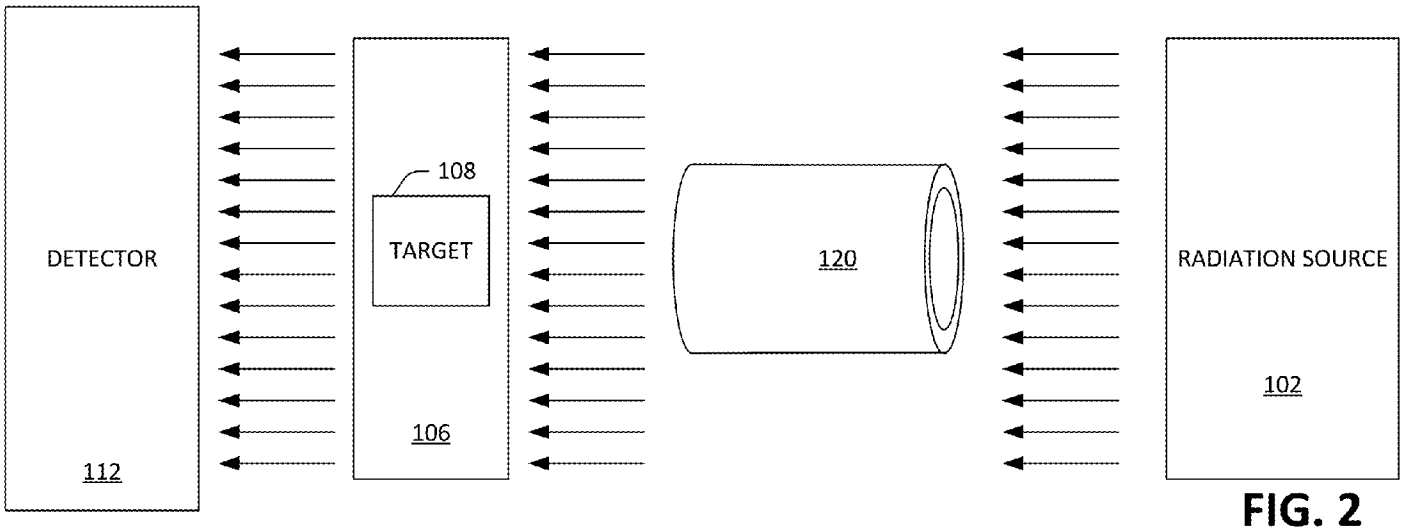
FIG. 2 illustrates an exemplary aiming device that can be used to relatively precisely aim a disrupter towards a target.

With reference now to FIG. 2, an exemplary implementation of the aiming device 120 is illustrated. In the exemplary embodiment shown in FIG. 2, the aiming device 120 is formed as a hollow cylinder, wherein such cylinder can be composed of a metal, a plastic, or the like. Radiation emitted by the radiation source 102 passes through a hollow region of the aiming device 120 and around the aiming device 120, but is attenuated by the walls of the aiming device 120 in the circular cross section of the aiming device 120. Radiation emitted by the radiation source 102 then impacts the target object 106 and the target therein 108, which again, attenuates such radiation. The detector 112 detects radiation emanating from the distal side 110 of the target object 106.

Figure 3:
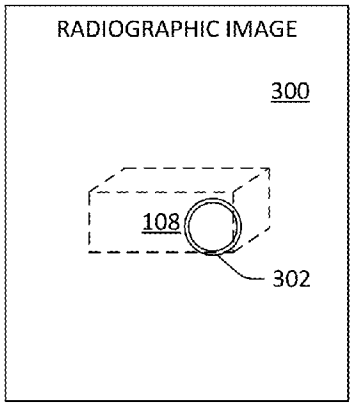
FIG. 3 is an exemplary radiographic image that can be used to relatively precisely aim a disrupter towards a target.

With reference to FIG. 3, an exemplary radiographic image 300 is illustrated, wherein the radiographic image 300 comprises an aim point corresponding to the aiming device 120 (in the exemplary embodiment shown in FIG. 2). The radiographic image 300 includes the target 108. The radiographic image 300 further includes an aim point 302, which is an image of the circular cross-section of the wall of the cylindrical aiming device 120 relative to the target 108. Since the cross-section of the wall of the aiming device 120 is shown in the radiographic image 300 as being on the target 108, the analyst 117 can indicate that the aim point 302 is at a location on the target 108 that is desired, and can cause the disrupter 118 to be aimed based upon the location of the aim point 302 in the radiographic image 300.

Figure 4:
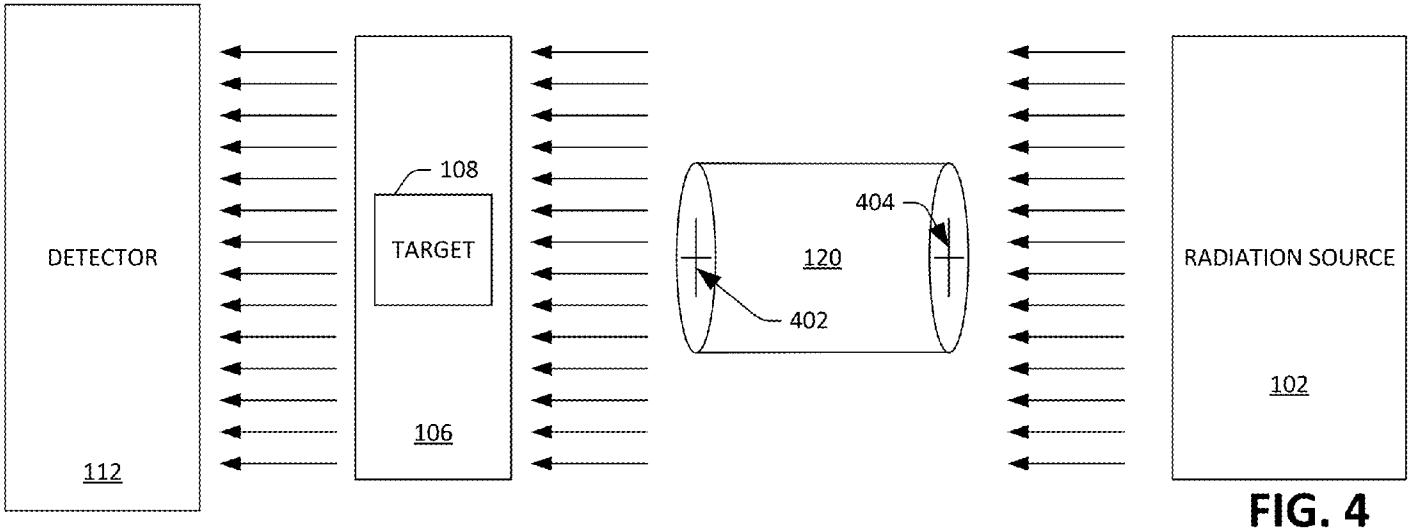
FIG. 4 illustrates an exemplary aiming device that can be used to relatively precisely aim a disrupter towards a target.

With reference now to FIG. 4, an exemplary implementation of the aiming device 120 that may facilitate even more precise aiming of the disrupter 118 towards the target 108 is illustrated. The aiming device 120 includes a pair of aiming mechanisms 402 and 404, shown in FIG. 4 as being crosshairs. It is to be understood, however, that the aiming mechanisms may be of any suitable shape. The aiming mechanisms 402 and 404 are spatially separated from one another; thus, the first aiming device 402 is positioned closer to the target 108 when compared to the second aiming mechanism 404. As will be shown below, utilization of the aiming mechanisms 402 through 404 can increase precision with respect to aiming the disrupter 118 towards the target 108, as the aiming mechanisms form an aiming axis.

Figure 5:
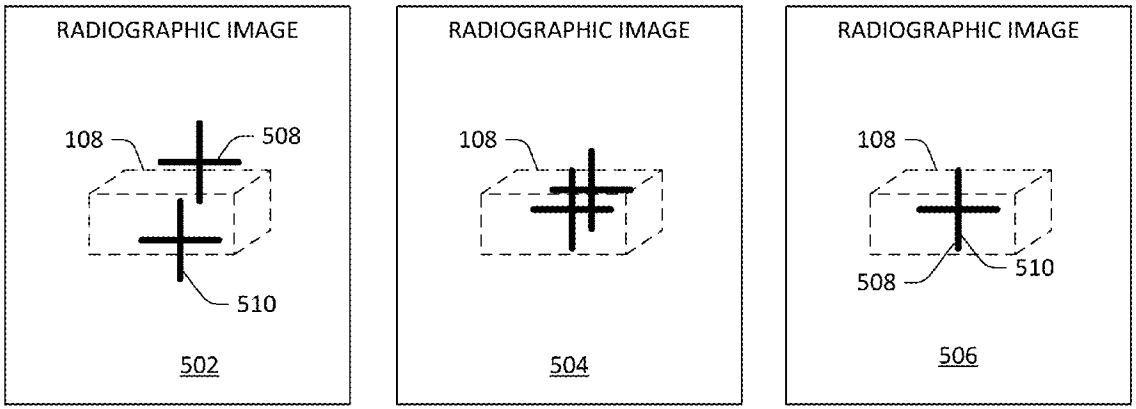
FIG. 5 illustrates a plurality of radiographic images that can be used to relatively precisely aim a disrupter towards a target.

Turning to FIG. 5, a series of radiographic images 502-506 are depicted. The first radiographic image 502 includes a first aim point 508 and a second aim point 510 that are misaligned with respect to one another. Accordingly, the aiming device 120 may be somewhat tilted with respect to the radiation source 102 and/or the target 108. The analyst 117 can cause the position of the target object 106, the position of the aiming device 120, and/or the position of the radiation source 102 to be altered in an attempt to cause the first aim point 508 and the second aim point 510 to be more closely aligned in a subsequently captured radiographic image.

As shown in the second radiographic image 504, movement of the at least one of the target object 106, the aiming device 120, or the radiation source 102 can cause the aim points 508 and 510 to be more closely aligned, thereby allowing the analyst 117 to have increased confidence when causing the disrupter 118 to emit a projectile. The analyst 117 may then further cause the aiming device 120, the target object 106, and/or the radiation source 102 to be moved, such that, in the third radiographic image 506, the aim points 508 and 510 are more closely aligned. As shown in the third radiographic image 506, the aim points 508 and 510 are coincident with one another. That is, the aiming axis of the aiming device 120 is relatively precisely directed to the location on the target 108 that corresponds to the location in the third radiographic image 506 where the aim points 508 and 510 are coincident on the target 108.

Figure 6:
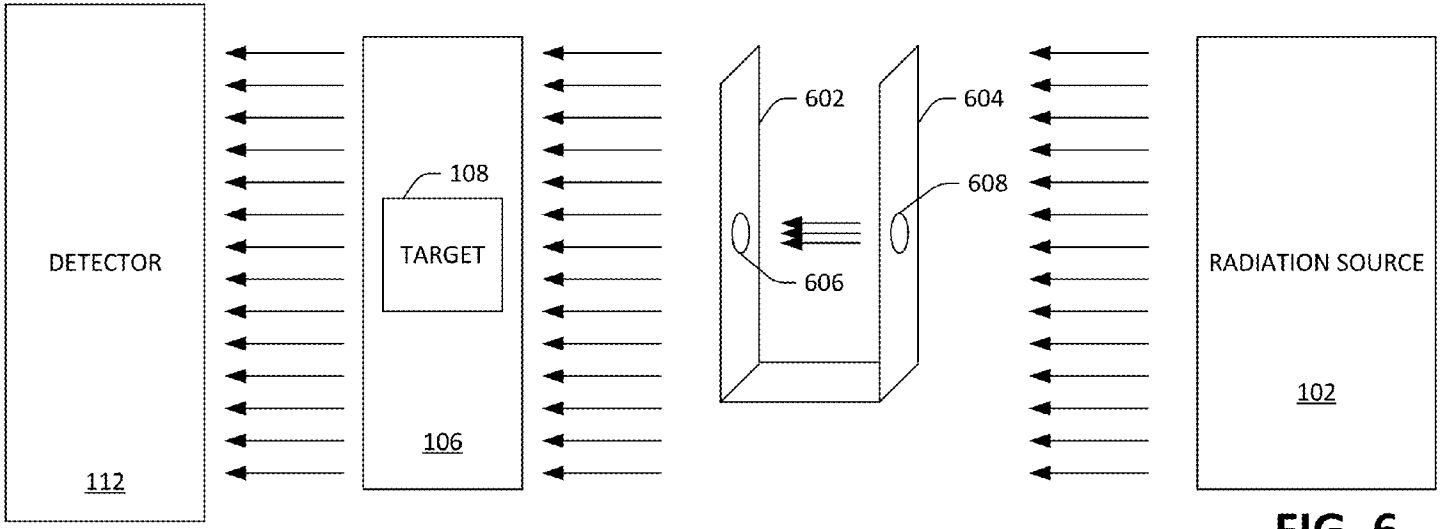
FIG. 6 illustrates an exemplary aiming device that can be used to relatively precisely aim a disrupter towards a target.

Turning now to FIG. 6, yet another implementation of the aiming device 120 is shown. In such an example, the aiming device 120 can be formed of parallel plates 602 and 604, each plate comprising a respective aperture 606 and 608. Radiation emitted by the radiation source 102 is attenuated by the plates 602 and 604, but can pass through the apertures 606 and 608. Radiation passing through the apertures 606 and 608 is directed along an axis formed between the apertures 606 and 608, and impacts the target object 106. The radiation that impacts the target object 106 (and target 108) is attenuated, and the detector 112 detects the radiation emanating from the distal side 110 of the target 110.

Figure 7:
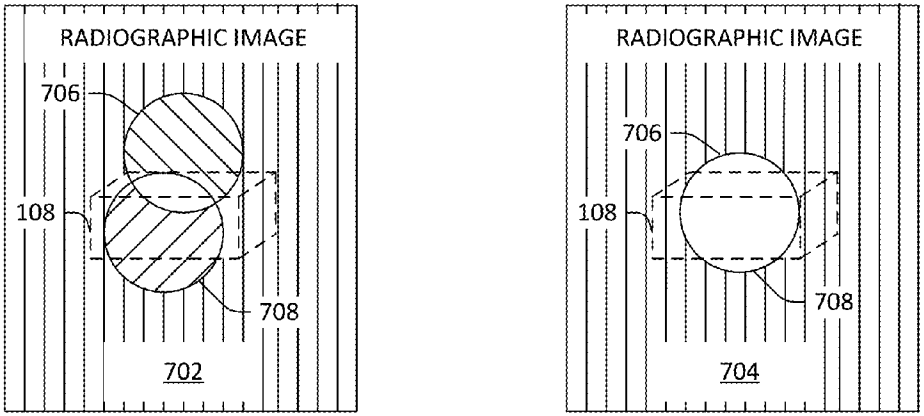
FIG. 7 illustrates a plurality of radiographic images that can be analyzed in connection with relatively precisely aiming a disrupter towards a target.

With reference to FIG. 7, a pair of radiographic images 702 and 704 are shown. The first radiographic image 702 includes a first aim point 706 and a second aim point 708. As with the aim points shown in FIG. 5, it is desirable that the aim points 706 and 708 be coincident with one another, instead of partially overlapping as shown in the first radiographic image 702. In the second radiographic image 704, the aiming device 120, the radiation source 102, and/or the target object 106 has been moved (compared to their respective positions pertaining to the first radiographic image 702), such that the aiming points 706 and 708 entirely overlap, providing a bright view of a portion of the target 108 in the second radiographic image 704. A projectile emitted by the disrupter 118 will travel along the projection axis (coincident with the aiming axis corresponding to the aim points 706 and 708 in the second radiographic image 704) and impact the target 108 at a location thereon that corresponds to the coincident aim points.

Figure 8:
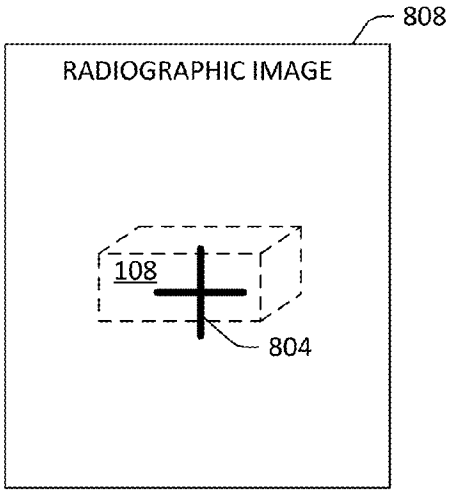
FIG. 8 illustrates a plurality of radiographic images that can be used to relatively precisely aim a disabler towards a target.
Figure 8:
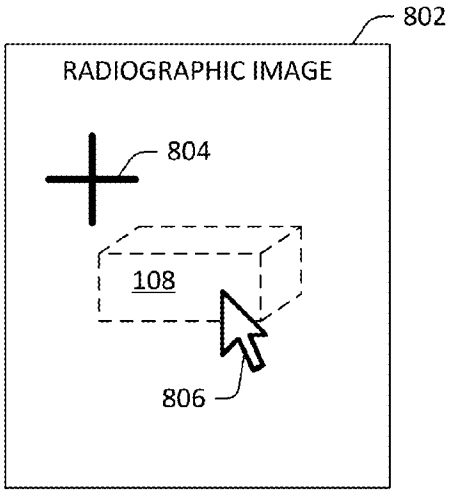

With reference now to FIG. 8, an automated approach to aligning/positioning the aiming device 120 is illustrated. In a first radiographic image 802, an aim point 804 is shown as being misaligned with the target 108. The analyst 117 can employ a cursor 806 (or a touch-sensitive display) to select a location in the first radiographic image 802 where the aim point 804 is desirably placed. Selection of such portion of the radiographic image 802 can cause the computing device 116 to transmit a control signal to the actuator 122, which can then cause the aiming device 120 to be repositioned, such that the aim point in a subsequently generated radiographic image will be at the location relative to the target 108 selected by the analyst 117. As shown in the second radiographic image 808, the actuator 122 has repositioned the aiming device 120 such that the aim point 804 is located on the target 108 in the second radiographic image 808 at the location specified by the analyst 117. The analyst 117 can thus be informed that the aiming device 120 is properly aligned with respect to the target 108, and the disrupter 118 can then be configured to be aimed such that the projection axis of the disrupter 118 intercepts the target 108 at a location that corresponds to the aim point 804 in the second radiographic image 808.

Figure 9:
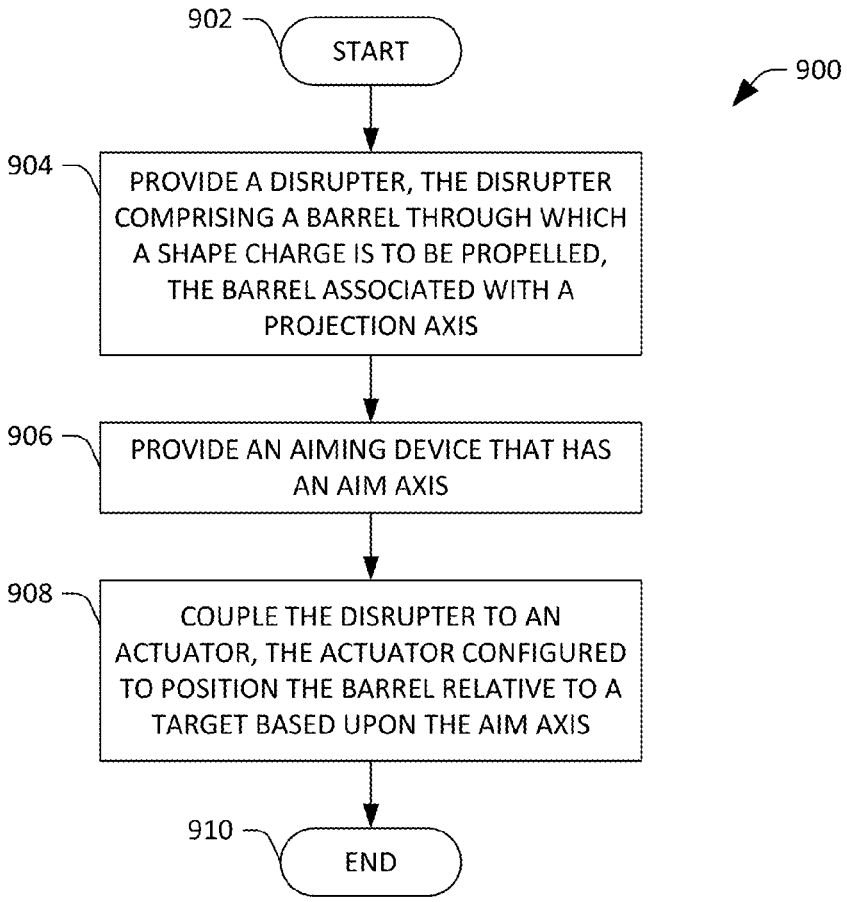
FIG. 9 is a flow diagram illustrating an exemplary methodology for constructing an apparatus that can be employed to relatively precisely aim a disrupter towards a target.
Figure 10:
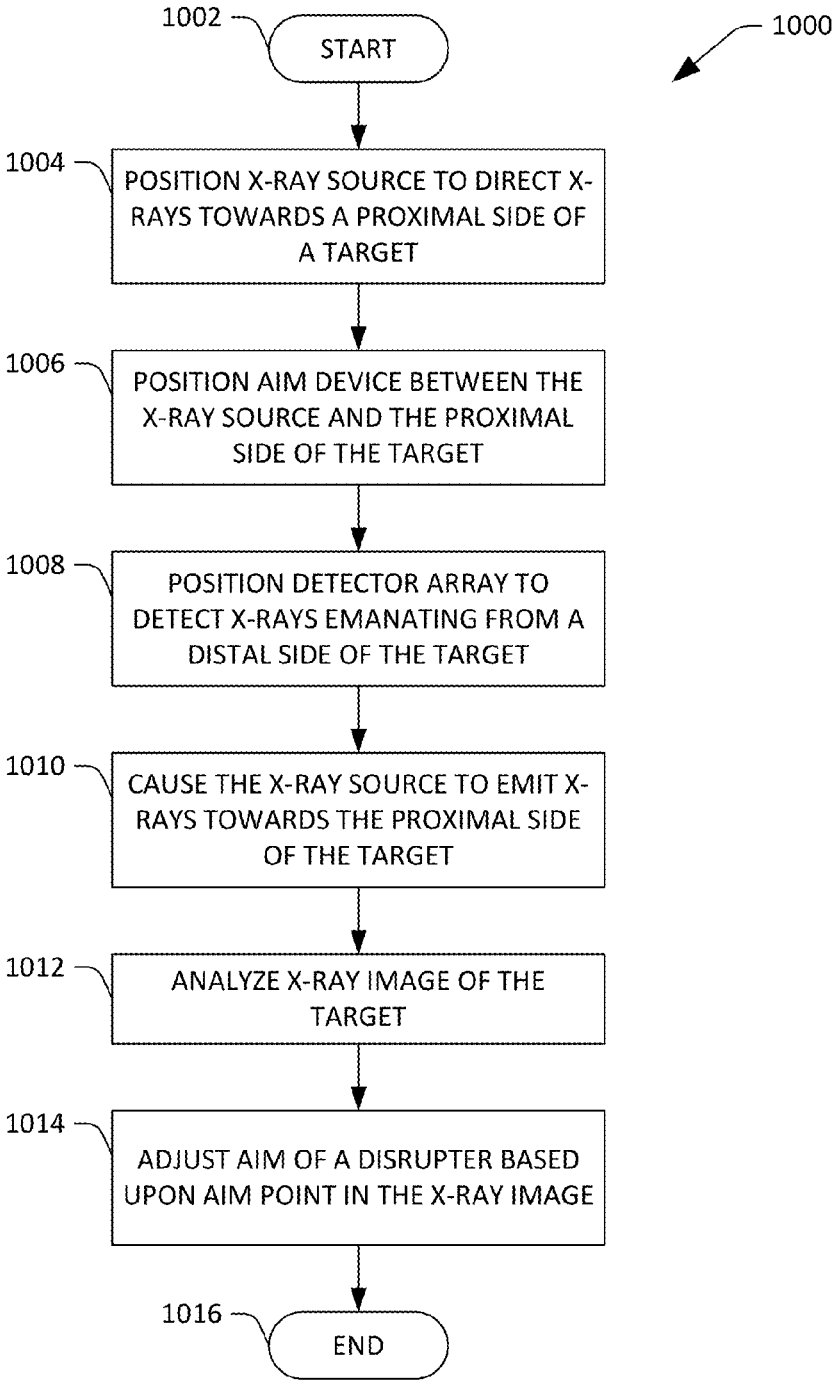
FIG. 10 is a flow diagram illustrating an exemplary methodology for adjusting the aim of a disabler with respect to a target based upon a radiographic image that comprises an aiming device superimposed on a target.
Figure 11:
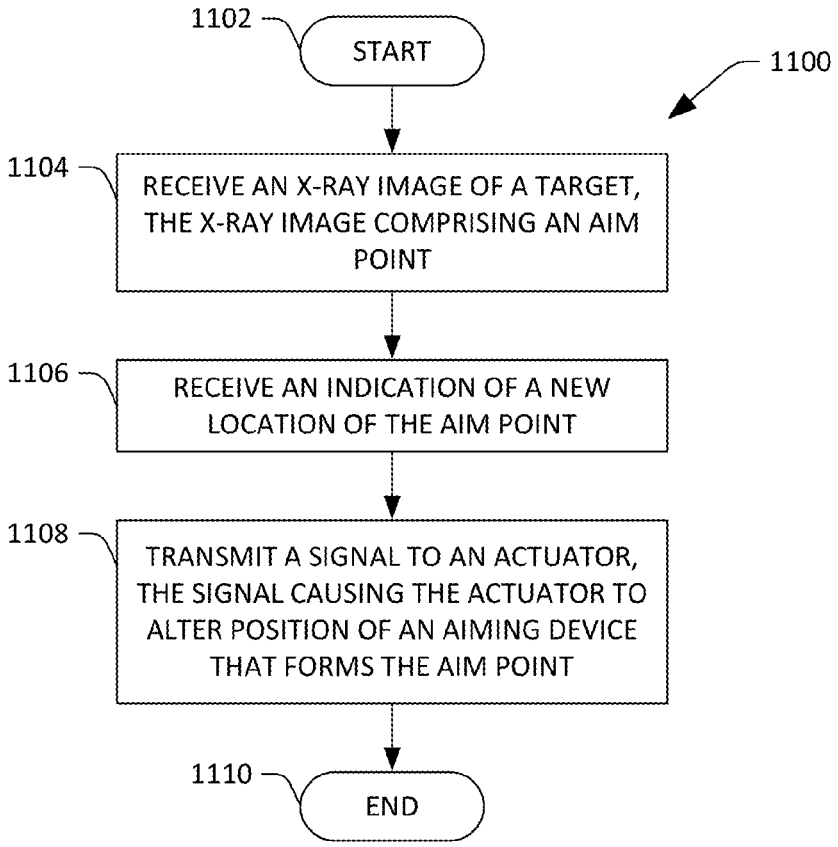
FIG. 11 is a flow diagram illustrating an exemplary methodology for adjusting the aim of a disabler relative to a target based upon user interaction with a radiographic image.

FIGS. 9-11 illustrate exemplary methodologies relating to precisely aligning a disrupter towards a target. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

Moreover, the acts described herein may be computer-executable instructions that can be implemented by one or more processors and/or stored on a computer-readable medium or media. The computer-executable instructions can include a routine, a sub-routine, programs, a thread of execution, and/or the like. Still further, results of acts of the methodologies can be stored in a computer-readable medium, displayed on a display device, and/or the like.

Now referring to FIG. 9, an exemplary methodology 900 that facilitates forming a system that can be utilized to precisely aim a disrupter towards a target is illustrated. The methodology 900 starts at 902, and at 904, a disrupter is provided. The disrupter comprises a barrel through which a shape charge is to be propelled, wherein the barrel has a projection axis extending therefrom. As indicated above, the shape charge can be relatively small in size, such as on the order of several millimeters in width. At 906, an aiming device that has an aim axis is provided. Exemplary aiming devices have been set forth above.

At 908, the disrupter is coupled with an actuator, wherein the actuator is configured to position the barrel relative to a target based upon the aim axis. The methodology 900 completes at 910.

Turning now to FIG. 10, an exemplary methodology 1000 that facilitates adjusting the aim of a disrupter is illustrated. The methodology 1000 starts at 1002, and at 1004, an x-ray source is positioned to direct x-rays towards a proximal side of a target. At 1006, an aiming device is positioned between the x-ray source and the proximal side of the target. At 1008, a detector is positioned to detect x-rays emanating from a distal side of the target, wherein such x-rays were emitted by the x-ray source.

In 1010, the x-ray source is caused to emit x-rays towards the proximal side of the target. At 1012, a radiographic image of the target is analyzed, wherein such image includes an aim point formed by the aiming device being positioned between the x-ray source and the proximal side of the target. At 1014, the disrupter is positioned such that it is aimed at the target at a location thereon that corresponds to the location of the aim point in the x-ray image. The methodology 1000 completes at 1016.

Now referring to FIG. 11, an exemplary methodology 1100 for aiming a disrupter relatively precisely towards a target is illustrated. The methodology 1100 starts 1102, and at 1104 a radiographic image of a target is received, wherein the radiographic image comprises an aim point. At 1106, an indication of a new location of the aim point is received on the radiographic image. For instance, as described with respect to FIG. 8, the analyst 117 can select a position on the radiographic image where the aim point is desirably located. At 1108, a signal is transmitted to an actuator, wherein the signal causes the actuator to alter the position of an aiming device, wherein mechanical features of the aiming device form the aim point in the radiographic image. This can cause the aim point in a subsequently generated image to be at the location relative to the target selected by the analyst. This semi-automated approach facilitates more expeditious aiming of the disrupter compared to conventional approaches. The methodology 1100 completes at 1110.

Figure 12:
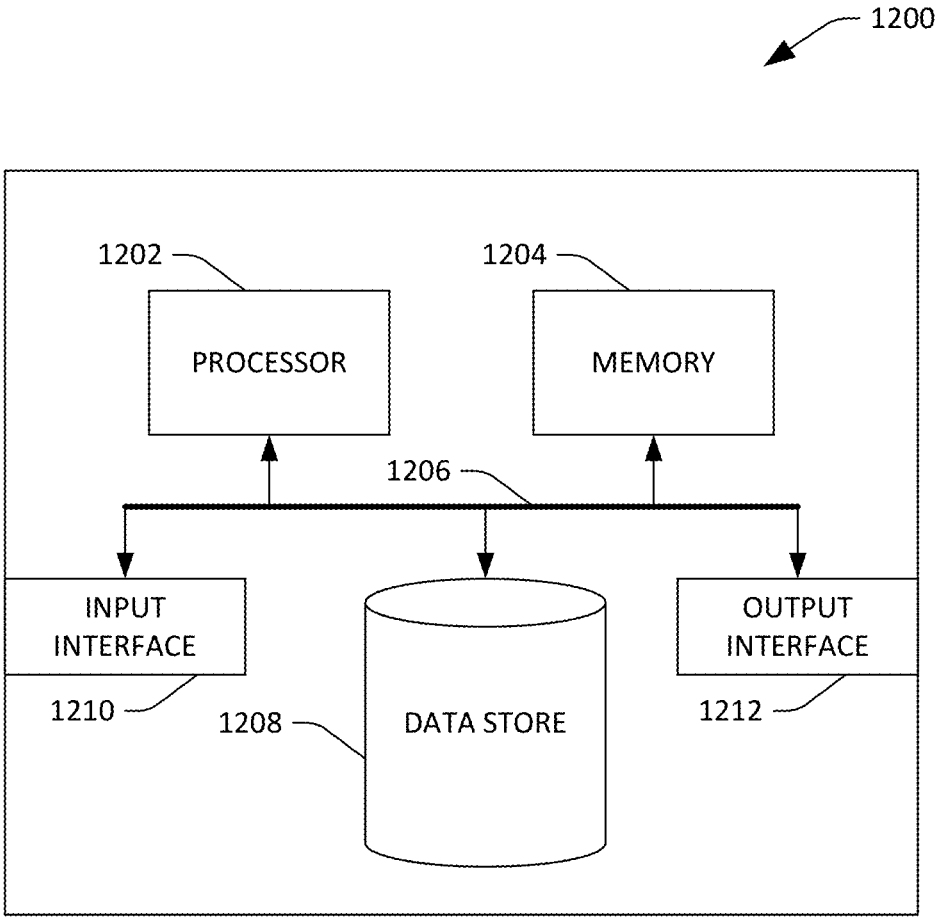
FIG. 12 is an exemplary computing system.

Referring now to FIG. 12, a high-level illustration of an exemplary computing device 1200 that can be used in accordance with the systems and methodologies disclosed herein is illustrated. For instance, the computing device 1200 may be used in a system that supports aligning a disrupter relative to a target. By way of another example, the computing device 1200 can be used in a system that supports causing a disrupter to emit a projectile towards a target. The computing device 1200 includes at least one processor 1202 that executes instructions that are stored in a memory 1204. The instructions may be, for instance, instructions for implementing functionality described as being carried out by one or more components discussed above or instructions for implementing one or more of the methods described above. The processor 1202 may access the memory 1204 by way of a system bus 1206. In addition to storing executable instructions, the memory 1204 may also store images, aim point locations, etc.

The computing device 1200 additionally includes a data store 1208 that is accessible by the processor 1202 by way of the system bus 1206. The data store 1208 may include executable instructions, images, aim point locations, etc. The computing device 1200 also includes an input interface 1210 that allows external devices to communicate with the computing device 1200. For instance, the input interface 1210 may be used to receive instructions from an external computer device, from a user, etc. The computing device 1200 also includes an output interface 1212 that interfaces the computing device 1200 with one or more external devices. For example, the computing device 1200 may display text, images, etc. by way of the output interface 1212.

It is contemplated that the external devices that communicate with the computing device 1200 via the input interface 1210 and the output interface 1212 can be included in an environment that provides substantially any type of user interface with which a user can interact. Examples of user interface types include graphical user interfaces, natural user interfaces, and so forth. For instance, a graphical user interface may accept input from a user employing input device(s) such as a keyboard, mouse, remote control, or the like and provide output on an output device such as a display. Further, a natural user interface may enable a user to interact with the computing device 1200 in a manner free from constraints imposed by input device such as keyboards, mice, remote controls, and the like. Rather, a natural user interface can rely on speech recognition, touch and stylus recognition, gesture recognition both on screen and adjacent to the screen, air gestures, head and eye tracking, voice and speech, vision, touch, gestures, machine intelligence, and so forth.

Additionally, while illustrated as a single system, it is to be understood that the computing device 1200 may be a distributed system. Thus, for instance, several devices may be in communication by way of a network connection and may collectively perform tasks described as being performed by the computing device 1200.

Various functions described herein can be implemented in hardware, software, or any combination thereof. If implemented in software, the functions can be stored on or transmitted over as one or more instructions or code on a computer-readable medium. Computer-readable media includes computer-readable storage media. A computer-readable storage media can be any available storage media that can be accessed by a computer. By way of example, and not limitation, such computer-readable storage media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, include compact disc (CD), laser disc, optical disc, digital versatile disc (DVD), floppy disk, and Blu-ray disc (BD), where disks usually reproduce data magnetically and discs usually reproduce data optically with lasers. Further, a propagated signal is not included within the scope of computer-readable storage media. Computer-readable media also includes communication media including any medium that facilitates transfer of a computer program from one place to another. A connection, for instance, can be a communication medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio and microwave are included in the definition of communication medium. Combinations of the above should also be included within the scope of computer-readable media.

Alternatively, or in addition, the functionally described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A system, comprising:

a radiation source positioned to emit radiation towards a proximal side of a target;

a detector that is positioned to detect radiation emitted from the radiation source that emanates from a distal side of the target;

an imager that is configured to generate a radiographic image based upon the radiation detected by the detector;

a disrupter that is configured to emit a disruptive element along a projection axis, the disrupter positioned such that the disruptive element initially impacts the proximal side of the target; and an aiming device positioned between the radiation source and the target, wherein the radiographic image comprises the target and an aim point, the aim point being a mechanical feature of the aiming device in the radiographic image, the disrupter alignable such that the projection axis intersects the target at a location thereon that corresponds to the aim point in the radiographic image.

2. The system of claim 1, the disruptive element being a shape charge, the shape charge having a diameter between 1 mm and 50 mm.

3. The system of claim 1, the disrupter being a laser, and the disruptive element being a laser beam.

4. The system of claim 1, further comprising an actuator that is configured to control position of the disrupter, the actuator positioning the disrupter such that the projection axis intersects the target at the location thereon that corresponds to the aim point in the radiographic image responsive to receipt of user input.

5. The system of claim 1, the aiming device comprising a first aiming mechanism and a second aiming mechanism that are spatially separated, an aiming axis formed between the first aiming mechanism and the second aiming mechanism, the aim point comprising a first aim point corresponding to the first aiming mechanism and a second aim point corresponding to the second aiming mechanism, the first and second aim points coincident in the radiographic image.

6. The system of claim 5, the disrupter alignable such that the projection axis is coincident with the aiming axis, the aiming axis corresponding to a time that the aim point was captured in the radiographic image.

7. The system of claim 5, the disrupter and the aiming device mechanically linked, wherein the aiming device is displaced as the disrupter is positioned such that the projection axis is coincident with the aiming axis corresponding to a time that the aim point was captured in the radiographic image.

8. The system of claim 1, further comprising:

a computing device that comprises the imager;

a display screen electrically coupled to the computing device, the computing device transmitting the radiographic image for display on the display screen, wherein the computing device is further configured with instructions that, when executed, cause the computing device to perform acts comprising:

receiving an indication of a desired location of the aim point on the radiographic image displayed on the display screen; and responsive to receiving the indication, transmitting instructions to an actuator that drives the aiming device, the instructions causing the actuator to transition the aiming device to correspond to the desired location.

9. The system of claim 8, the acts further comprising:

transmitting a signal to at least one of the radiation source or the detector to cause a new radiographic image to be generated, the aim point located in the new radiographic image at the new aim position on the target.

10. The system of claim 9, the acts further comprising:

subsequent to transmitting the signal, receiving an indication that the disrupter is to be aimed at an updated location of the target that corresponds to the aim point; and responsive to receiving the indication, transmitting a second signal to the actuator, the actuator, responsive to receiving the second signal, positioning the disrupter such that the projection axis intersects the target at the updated location.

11. The system of claim 1, the radiation source being an x-ray source.

12. A method, comprising:

positioning an aiming device between a radiation source and a target;

generating a radiographic image of the target, the radiographic image of the target comprising at least one mechanical feature of the aiming device superimposed on the target in the radiographic image at an aim point;

positioning a disrupter relative to the target based upon a location of the aim point in the radiographic image; and causing the disrupter to emit a projectile towards the target subsequent to the positioning of the disrupter based upon the location of the aim point in the radiographic image;

wherein the projectile being a shape charge that has a diameter of between 1 mm and 50 mm.

13. The method of claim 12, the radiation source being a portable radiation source.

14. The method of claim 13, the portable radiation source being an x-ray source.

15. The method of claim 12, wherein the aiming device is attachable to a housing of the radiation source, wherein positioning of the aiming device between the radiation source and the target comprises attaching the aiming device to the housing of the radiation source, the method further comprising:

subsequent to generating the radiographic image and prior to positioning the disrupter relative to the target, detaching the aiming device from the housing of the radiation source, and wherein positioning of the disrupter relative to the target comprises attaching the disrupter to the housing of the radiation source at a location corresponding to where the aiming device was attached to the housing of the radiation source.

16. The method of claim 12, wherein the disrupter has a projecting axis along which the projectile is projected, wherein positioning the disrupter comprises aligning the projecting axis relative to the target such that the projecting axis intersects the target at a location thereon that corresponds to a location of the aim point in the radiographic image.

17. A computer-readable storage medium comprising instructions that, when executed by a processor, cause the processor to perform acts comprising:

generating a radiographic image of a target, the radiographic image comprising the target and an aim point superimposed thereon, the aim point based upon a mechanical feature of an aiming device positioned between a radiation source and the target;

subsequent to generating the radiographic image of the target, receiving an indication that a disrupter is desirably positioned relative to the target to emit a projectile that impacts the target at a location thereon that corresponds to the aim point in the radiographic image; and transmitting a signal to an actuator that causes the actuator to position the disrupter relative to the target in accordance with the indication.

18. The computer-readable storage medium of claim 17, the acts further comprising:

receiving a second indication that the disrupter desirably emits the projectile; and transmitting a second signal to the disrupter that causes the disrupter to emit the projectile.

19. The computer-readable storage medium of claim 17, the target being a surface-mounted circuit component.

* * * * *